US009708814B2

(12) United States Patent
Vander Laan et al.

(10) Patent No.: US 9,708,814 B2
(45) Date of Patent: Jul. 18, 2017

(54) FORMED INTERLOCKING ROOFING PANELS

(71) Applicant: Quality Edge, Inc., Walker, MI (US)

(72) Inventors: Paul W. Vander Laan, Hamilton, MI (US); Mike Moerler, Fennville, MI (US); Todd Alexander, Rockford, MI (US)

(73) Assignee: Quality Edge, Inc., Walker, MI (US)

( * ) Notice: Subject to any disclaimer, the term of this patent is extended or adjusted under 35 U.S.C. 154(b) by 0 days.

(21) Appl. No.: 14/994,551

(22) Filed: Jan. 13, 2016

(65) Prior Publication Data

US 2016/0123014 A1 May 5, 2016

Related U.S. Application Data

(62) Division of application No. 13/791,327, filed on Mar. 8, 2013, now Pat. No. 9,267,289.

(51) Int. Cl.

| | |
|---|---|
| ***E04D 1/00*** | (2006.01) |
| ***E04D 1/26*** | (2006.01) |
| ***E04D 3/30*** | (2006.01) |
| ***E04D 3/365*** | (2006.01) |
| ***E04C 2/30*** | (2006.01) |
| *E04D 1/34* | (2006.01) |

(52) U.S. Cl.

CPC ..... *E04D 1/265* (2013.01); *E04C 2/30* (2013.01); *E04D 3/30* (2013.01); *E04D 3/365* (2013.01); *E04D 1/26* (2013.01); *E04D 2001/3458* (2013.01); *E04D 2001/3482* (2013.01)

(58) Field of Classification Search

CPC E04D 1/265; E04D 3/365; E04D 3/30; E04D 1/26; E04D 2001/3482; E04D 2001/3458; E04C 2/30

USPC ..... 52/478, 531, 537, 747

See application file for complete search history.

(56) References Cited

U.S. PATENT DOCUMENTS

| | | | | |
|---|---|---|---|---|
| 361,031 | A | 4/1887 | Thorn | |
| 422,571 | A | 3/1890 | Cooper | |
| 720,893 | A | 2/1903 | Charlebois | |
| 1,110,272 | A | 9/1914 | Probert | |
| 1,121,594 | A | 12/1914 | Probert | |
| 1,204,885 | A | 11/1916 | Koerner | |
| 1,510,614 | A | 10/1924 | Torrence | |
| 2,565,610 | A * | 8/1951 | Kinghorn | E04D 3/363 285/424 |
| 2,682,236 | A | 6/1954 | Holmstrom et al. | |

(Continued)

*Primary Examiner* — Basil Katcheves
*Assistant Examiner* — Joshua Ihezie
(74) *Attorney, Agent, or Firm* — Price Heneveld LLP

(57) ABSTRACT

An interlocking panel system for top-down installation on an underlying structure including a plurality of panels, with an uphill course and a downhill course where each panel is generally rectangular, having an uphill edge and opposing downhill edge. An interlocking member is disposed along the uphill edge, and a receiving member adapted to receive the interlocking member and a joining flange are disposed along the downhill edge. A panel of the uphill course is affixed to an underlying structure via fasteners through the joining flange. The interlocking member of a panel of the downhill course is insertable into the receiving member of the uphill course, and the position of the panel of the downhill course is adjustable within the span of the receiving member.

20 Claims, 3 Drawing Sheets

(56) References Cited

U.S. PATENT DOCUMENTS 2,766,861 A * 10/1956 Abramson ..... E04F 13/0864 52/530
2,948,367 A * 8/1960 Uglietto ..... E04F 13/0864 52/531
3,001,332 A * 9/1961 Wilder ..... E04B 1/7076 227/68
3,157,003 A * 11/1964 Domar ..... E04F 13/0864 52/531
3,218,772 A 11/1965 Martin
3,233,382 A * 2/1966 Graveley, Jr. ..... E04F 13/0864 52/522
3,377,762 A * 4/1968 Chalmers ..... E04D 1/265 52/313
3,603,057 A * 9/1971 Curran ..... E04F 13/12 52/478
3,703,795 A * 11/1972 Mattes ..... E04F 13/0864 52/409
3,760,545 A 9/1973 Pearse et al.
3,852,933 A * 12/1974 Guzzo ..... E04D 3/365 52/520
4,084,365 A 4/1978 Read
4,187,661 A * 2/1980 Poiry ..... E04G 23/08 52/514
4,356,673 A * 11/1982 Gailey ..... E04F 13/0864 52/127.1
4,450,665 A * 5/1984 Katz ..... E04F 13/0864 52/522
4,669,238 A * 6/1987 Kellis ..... E04F 13/0864 52/105
4,759,165 A * 7/1988 Getoor ..... E04D 3/30 29/425
5,012,623 A * 5/1991 Taylor ..... E04D 3/362 52/478
5,022,207 A * 6/1991 Hartnett ..... E04D 13/152 52/478
5,074,093 A 12/1991 Meadows
5,355,649 A * 10/1994 Berridge ..... E04D 3/362 52/394
5,495,654 A * 3/1996 Goodhart ..... E04D 1/06 29/428
5,519,974 A * 5/1996 Greenberg ..... E04D 3/363 52/518
5,685,117 A * 11/1997 Nicholson ..... E04D 1/18 52/520
5,953,810 A * 9/1999 Goodhart ..... E04D 1/18 29/557
5,956,913 A * 9/1999 Nicholson ..... E04D 1/18 52/520
6,298,625 B1 * 10/2001 Sweet ..... E04D 3/30 52/409
7,308,777 B2 12/2007 Sandow
7,571,571 B1 * 8/2009 Mershon ..... A47F 5/0846 211/94.01
7,591,115 B2 * 9/2009 Morris ..... E04D 3/365 52/489.1
7,677,004 B2 * 3/2010 LaLonde ..... E04B 9/30 52/243.1
7,739,847 B2 * 6/2010 Griman ..... E04F 13/0864 52/478
8,898,977 B2 * 12/2014 Gulino ..... E04F 13/0733 52/287.1
2005/0072091 A1 * 4/2005 Morris ..... E04B 7/205 52/518
2006/0144002 A1 * 7/2006 Charlwood ..... E04D 3/30 52/519
2007/0101665 A1 * 5/2007 Sandow ..... E04D 13/0305 52/200
2010/0186334 A1 7/2010 Seem

* cited by examiner 10
14
28
52
48
50
VI

FORMED INTERLOCKING ROOFING PANELS

CROSS-REFERENCE TO RELATED APPLICATIONS

The present application is a divisional of U.S. patent application Ser. No. 13/791,327 filed Mar. 8, 2013, entitled "FORMED INTERLOCKING ROOFING PANELS," the entire disclosure of which is hereby incorporated herein by reference. U.S. patent application Ser. No. 13/791,327 is related to U.S. patent application Ser. No. 13/791,437 filed on Mar. 8, 2013, entitled "FORMED INTERLOCKING ROOFING PANELS," now U.S. Pat. No. 8,915,036, the entire disclosure of which is hereby incorporated herein by reference.

BACKGROUND OF THE INVENTION

The invention is in the field of interlocking panels for installation on an underlying structure.

SUMMARY OF THE INVENTION

In one aspect, the invention includes an interlocking panel system for top-down installation on an underlying structure, including a plurality of panels defining an uphill course of panels and a downhill course of panels. Each of the panels includes a generally rectangular panel body with an uphill edge and an opposing downhill edge. An angled head is disposed along the uphill edge of each panel body and a receiving member is disposed along the downhill edge of each panel body. The receiving member of the uphill course of panels is adapted to receive the angled head of the downhill course of panels, and the receiving member has a span which permits positional adjustment of the downhill course of panels within a defined range. A joining flange is disposed along the length of the receiving member for affixing the panel to the underlying structure, and the joining flange is disposed between the underlying structure and the downhill course of panels upon installation.

In another aspect, the invention includes an interlocking panel for top-down installation on an underlying structure. The interlocking panel has a generally rectangular panel body, with an uphill edge and an opposing downhill edge; an interlocking member disposed along the uphill edge of the panel body; and a receiving member disposed along the downhill edge of the panel body, wherein the receiving member is adapted to loosely receive an adjacent interlocking panel and permits positional adjustment of the interlocking panel in the uphill-downhill direction within a defined range.

Another aspect of the invention is a method of installing interlocking panels over an underlying structure, including the step of affixing a first panel to the underlying structure, wherein the first panel includes a first panel body with a first uphill edge and an opposing first downhill edge and wherein a first receiving member having a span is disposed along the first downhill edge of the first panel body, and wherein the first panel is affixed so that the first uphill edge is higher on the structure than the first downhill edge. A second panel is provided, and the second panel includes a second panel body with a second uphill edge and an opposing second downhill edge and wherein a second interlocking member is disposed along the second uphill edge of the second panel body. The second interlocking member is inserted into the first receiving member; and its position is adjusted in the uphill-downhill direction with respect to the first panel within the span of the first receiving member. The second panel is then affixed to the underlying structure.

These and other features, advantages, and objects of the present invention will be further understood and appreciated by those skilled in the art by reference to the following specification, claims, and appended drawings.

DETAILED DESCRIPTION OF EMBODIMENTS

Figure 1:
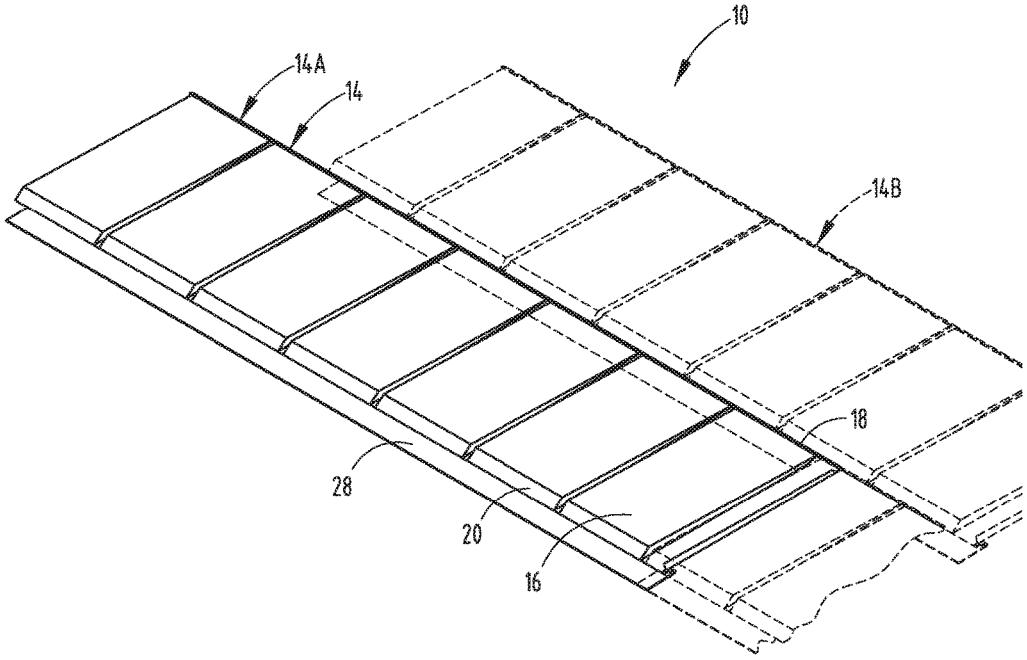
FIG. 1 is a top perspective view of one embodiment of an interlocking panel according to one embodiment of the present invention.

For purposes of description herein the terms "upper," "lower," "right," "left," "rear," "front," "vertical," "horizontal" and derivatives thereof shall relate to the invention as oriented in FIG. 1. However, it is to be understood that the invention may assume various alternative orientations and step sequences, except where expressly specified to the contrary. As used herein, "uphill" or the "uphill direction" refers to being located higher in the vertical direction (upon installation, unless described otherwise). Correspondingly, as used herein, "downhill" or the "downhill direction" refers to being located lower in the vertical direction (upon installation, unless described otherwise). It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The embodiment of an interlocking panel system 10 for installation on an underlying structure 12 shown in FIGS. 1-6A includes a plurality of panels 14. The panels 14 are suitable for installation on a roof, a wall, or other underlying structure 12 in a top-down manner. Once installed, the panels 14 form a watertight barrier over the underlying structure 12, with fasteners hidden from view.

Figure 2:
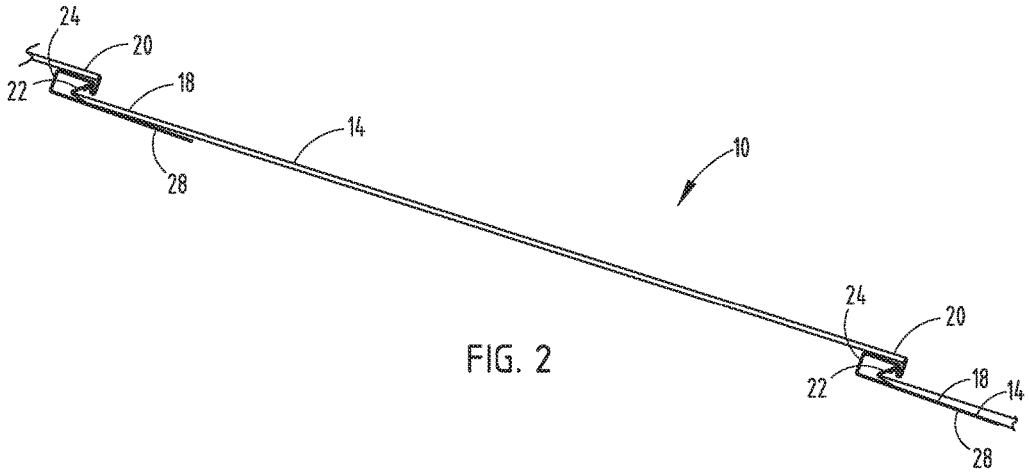
FIG. 2 is a side elevational view of an interlocking panel system.
Figure 3:
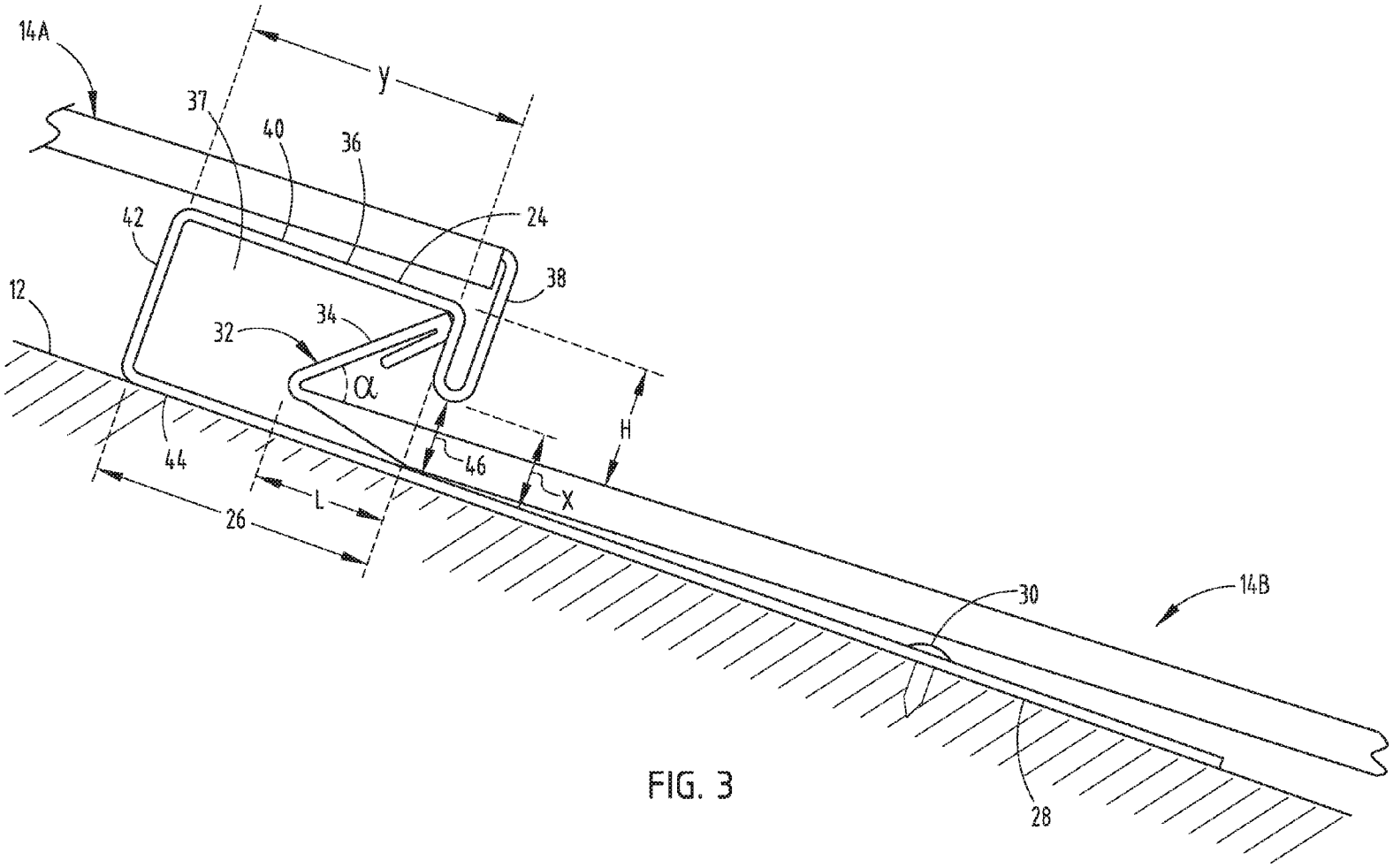
FIG. 3 is an enlarged side elevational view of an interlocking portion of the interlocking panel system of the present invention.

As best shown in the embodiment depicted in FIGS. 1-3, each of the panels 14 includes a generally rectangular panel body 16 with an uphill edge 18 and an opposing downhill edge 20. An interlocking member 22 is disposed along the uphill edge 18 of each panel body 16, and a receiving member 24 is disposed along the downhill edge 20 of each panel body 16. The receiving member 24 of each uphill panel 14A is adapted to receive the interlocking member 22 of an adjacent downhill panel 14B, and the receiving member 24 has a span 26, which permits positional adjustment of the downhill panel 14B within a defined range.

With reference again to FIGS. 1-3, a joining flange 28 is also disposed along a length of the receiving member 24 for affixing the panel 14 to the underlying structure 12. Upon installation of the adjacent downhill panel 14B, the joining flange 28 is disposed between the underlying structure 12 and the adjacent downhill panel 14B. The fasteners 30 are used to attach the joining flange 28 to the underlying structure 12. The fasteners 30 may be used for attachment of a roofing panel or a siding panel to the underlying structure 12, and are appropriate for affixing the joining flange 28 to the underlying structure 12, including, without limitation, nails, screws, adhesives, or other fasteners.

The interlocking member 22, as shown in the embodiment depicted in FIGS. 2 and 3, includes an angled head 32 disposed along the uphill edge 18 of the panel body 16. The angled head 32 includes a flange 34 that extends from the uphill edge 18 of the panel body 16, folding back over the panel body 16 at an angle $\alpha$ of less than 90 degrees from the panel body 16. The flange 34 of the angled head 32 extends a first length L over the panel body 16 and a first height H up from the surface of the panel body 16.

As shown in the embodiment depicted in FIGS. 2 and 3, the receiving member 24 includes a trough 36 disposed along the downhill edge 20 of the panel body 16. The trough 36 defines a receiving slot 37. The trough 36 includes a downwardly depending wall 38, a top wall 40, a back wall 42, and a bottom wall 44. The downwardly depending wall 38 depends from the downhill edge 20 of the panel body 16. The back wall 42 opposes the downwardly depending wall 38, and as shown in FIGS. 2 and 3, is located uphill from the downwardly depending wall 38. The back wall 42 also has a length which is greater than the length of the downwardly depending wall 38. Also, as shown in FIGS. 2 and 3, the bottom wall 44 extends beyond the downhill edge 20 of the panel body 16 to form the joining flange 28.

As shown in the embodiment depicted in FIG. 3, the difference in length between the back wall 42 and the downwardly depending wall 38 results in an opening 46 on a downhill side of the trough 36, allowing insertion of the interlocking member 22 into the receiving member 24. The opening 46 has a height X, which is less than the first height H that the flange 34 of the angled head 32 extends above the panel body 16. The flange 34 is a material which is at least slightly deformable, allowing it to be inserted through the opening 46, and then expand to the first height H, which is greater than the height X of the opening 46.

Additionally, a length Y of the top wall 40 is greater than the first length L that the flange 34 of the angled head 32 extends over the panel body 16. The difference in the length Y between the top wall 40 and the first length L of the flange 34 overlapping the panel body 16 allows positional adjustment of the downhill panel 14B with respect to the uphill panel 14A in an uphill-downhill direction. This room for adjustment (Y-L) allows for the alignment of adjacent courses of panels 14, and allows for coverage of potential inconsistencies in the underlying structure 12. The difference in length between the top wall 40 and the overlapping length of the flange 34 (Y-L) is preferably equal to or greater than about 0.25 inches, to allow for adjustment of the downhill course with respect to the uphill course.

Figures 4, 5, 6, 6A:
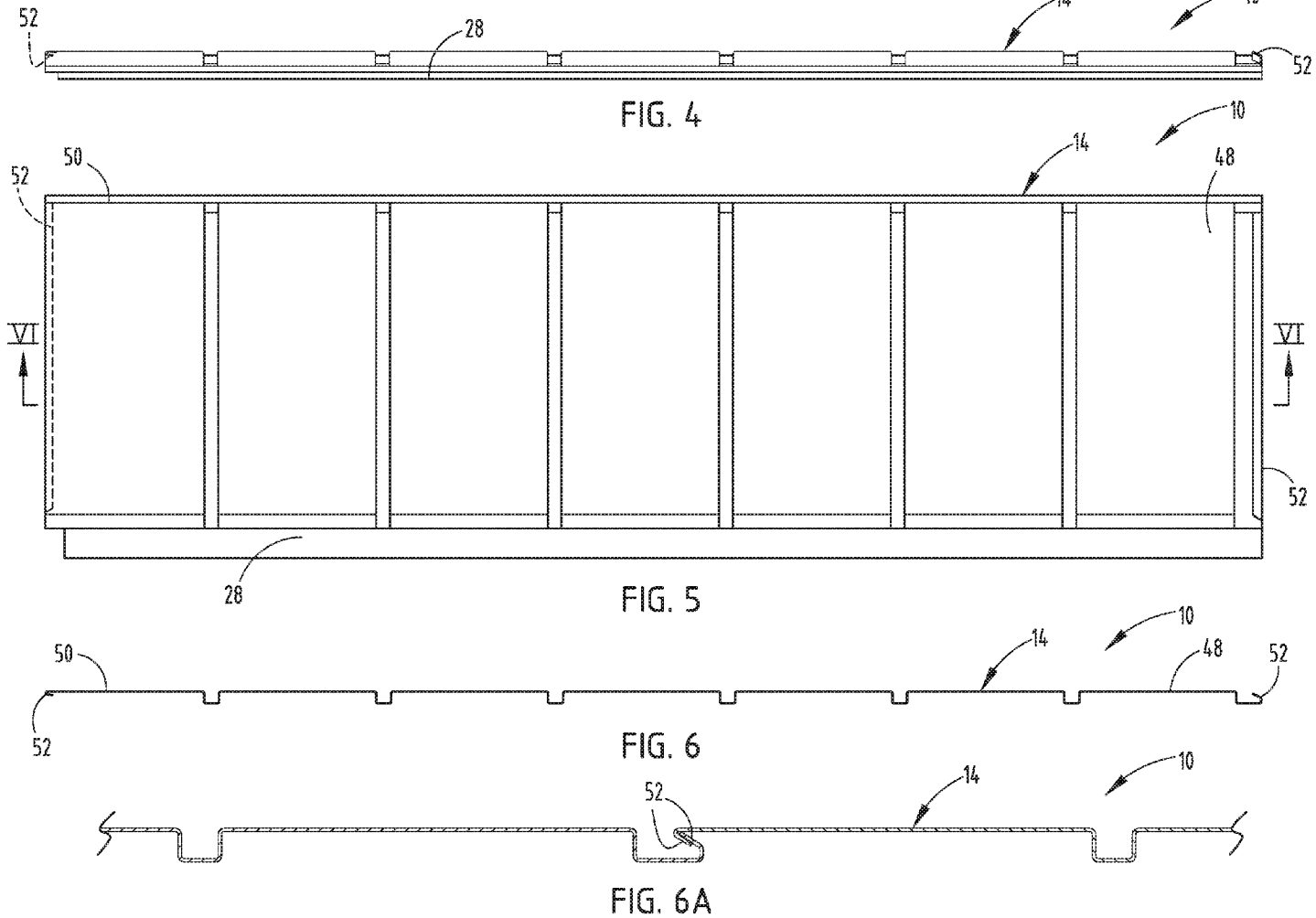
FIG. 4 is a side elevational view of two side-by-side interlocking panels.
FIG. 5 is a top plan view of an interlocking panel.
FIG. 6 is a cross-sectional side elevational view of the interlocking panel, taken along the line VI-VI in FIG. 5.
FIG. 6A is an enlarged cross-sectional side elevational view of two panels engaged.

As shown in the embodiment depicted in FIG. 4, each generally rectangular panel body 16 also includes a right edge 48 and a left edge 50, in addition to the uphill and downhill edges 18, 20. A watertight course of panels 14 includes panels 14 affixed to the underlying structure 12 from left to right (or right to left) to form a horizontal line with the left edge 50 of each panel 14 overlapping the right edge 48 of the adjacent panel 14 (or vice versa). As shown in the embodiment of FIGS. 1-6A, interlocking flange features 52 are provided on the right edge 48 and the left edge 50 to permit adjacent (side-by-side) panels 14 to interlock. Adjacent flange features 52 can be interlocked from left to right (or right to left) across the underlying structure 12, thereby allowing the panels 14 to be installed in the watertight horizontal course.

As best shown in the embodiment depicted in FIGS. 5-6A, each panel 14 may include more than one depiction of a "shingle" thereon, to maintain the appearance of traditional shingled roofing or siding materials, but to ease installation. In one embodiment, the panels 14 are formed to look like a multitude of slate/stone roofing tiles. The panels 14 may also include alternate patterns, stampings, or texturing to appear similar to existing materials, or to have a unique appearance not possible with existing roofing or siding materials. The panels 14 may be manufactured from any material (or a combination of materials) suitable for use as a roofing or siding material, which can be formed to have the described interlocking and receiving members, including, without limitation, metal suitable for use as a roofing or siding material.

To install the interlocking panel system 10 on an underlying structure 12, a first panel 14A is placed in position on the underlying structure 12 with the uphill edge 18 higher on the underlying structure 12 than the downhill edge 20, and is affixed thereto via the fasteners 30 through or applied to the joining flange 28. As affixed, the receiving member 24 is disposed along the downhill edge 20 of the first panel 14A. Adjacent panels 14A (to the right or left side of the first panel 14A) can then be optionally affixed to the underlying structure 12, overlapping the right and left edges 48, 50 of the previously installed panel 14A, to form an uphill course of panels 14A extending horizontally.

A second panel 14B is then positioned on the downhill side of the first panel 14A, such that its uphill edge 18 is facing the downhill edge 20 of the first panel 14A. The interlocking member 22 disposed along the uphill edge 18 of the second panel 14B is inserted into the receiving member 24 disposed along the downhill edge 20 of the first panel 14A, such that the interlocking member 22 is received within the receiving member 24. As best shown in FIG. 3, when the interlocking member 22 is received within the receiving member 24, the height H of the flange 34 of the angled head 32 is greater than the height X of the opening 46 to the receiving member 24. Consequently, the second panel 14B is retained in the receiving slot 37 of the first panel 14A.

The flange 34 of the angled head 32 also has a length L overlapping the second panel 14B, which is less than the span 26 of the receiving member 24. Due to this difference in length, once the interlocking member 22 of the second panel 14B is received within the receiving member 24, the second panel 14B is adjustable in the uphill-downhill direction within the span 26 of the receiving member 24, allowing the second panel 14B to be adjusted to take into account anomalies in the underlying structure 12 and to maintain straight lines over a course of panels 14. Once in the desired position, the second panel 14B is affixed to the underlying structure 12 via the fasteners 30 applied to or through the joining flange 28 on the downhill edge 20 of the second panel 14B.

An adjacent panel 14B (to the right or left side of the second panel 14B) is then optionally affixed to the underlying structure 12, overlapping the side edge of the previously installed panel 14B, to form a downhill course of panels 14B. The second panel 14B (or the downhill course of panels 14B) can then function as the first panel 14A (or uphill course of panels 14), allowing the installation of another course of panels 14 on the downhill edge 20 of the second panel 14B (or downhill course of panels 14B). When installing one course of panels 14B on the downhill edge 20 of an uphill course of panels 14A, the panels 14B of the downhill course may be aligned edge-to-edge with the uphill course of panels 14A, or may be offset therefrom to create a staggered arrangement.

With reference again to FIG. 3, the interlocking panel system 10, as described above, is able to be installed on the underlying structure 12 in a top-down manner, with hidden fasteners 30 to improve the appearance and improve the water barrier created by the interlocking panel system 10. The interlocking panel system 10 also incorporate span 26, which permits positional adjustment of the downhill panel 14B with respect to the uphill panel 14A, ensuring that the appearance of the interlocking panel system 10 remains uniform and forms a straight line at the desired bottom end-point, and that variations in the underlying structure 12 and any tolerance stack-ups are accommodated by the interlocking panel system 10.

It will be understood by one having ordinary skill in the art that construction of the described invention and other components is not limited to any specific material. Other exemplary embodiments of the invention disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the invention as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present invention. The exemplary structures and processes disclosed herein are for illustrative purposes and are not to be construed as limiting.

It is also to be understood that variations and modifications can be made on the aforementioned structures and methods without departing from the concepts of the present invention, and further it is to be understood that such concepts are intended to be covered by the following claims unless these claims by their language expressly state otherwise.

What is claimed is:

1. A method of installing interlocking panels over an underlying structure, the method including steps of:

affixing a first panel to the underlying structure, wherein the first panel comprises a first planar panel body with a first uphill edge and an opposing first downhill edge wherein at least the first downhill edge is engaged with the underlying structure, and wherein a receiving member having a span is disposed along the first downhill edge of the first planar panel body, and wherein the first panel is affixed so that the first uphill edge is higher on the structure than the first downhill edge;

providing a second panel, wherein the second panel includes a second planar panel body with a second uphill edge and an opposing second downhill edge, and wherein an interlocking member is disposed along the second uphill edge of the second planar panel body;

inserting the interlocking member into the receiving member, wherein the second uphill edge rests on a portion of the first downhill edge and the second downhill edge rests on the structure, wherein the interlocking member includes a bevel that extends above the first planar panel body of the first panel;

adjusting a position of the second panel in an uphill-downhill direction with respect to the first panel within the span of the receiving member; and affixing the second panel to the underlying structure.

2. The method of claim 1, wherein the first panel further comprises:

a joining flange disposed along a length of the first receiving member, and wherein the first panel is affixed to the underlying structure via attachment of the joining flange to the underlying structure.

3. The method of claim 2, wherein the first receiving member comprises:

a trough having a downwardly depending wall, a top wall, a back wall and a bottom wall, wherein the back wall has a length which is longer than the length of the downwardly depending wall, and wherein the downwardly depending wall is disposed in a downhill direction from the back wall, and there is an opening on the downhill side of the trough.

4. The method of claim 3, wherein the second interlocking member comprises:

a flange extending from the second uphill edge of the second planar panel body to form an angle of less than 90 degrees from the second planar panel body, and wherein the flange is inserted into the opening on the downhill side of the trough at least far enough for the entire flange to be disposed inside the trough.

5. The method of claim 4, wherein the second panel can be adjusted in an uphill direction until the second uphill edge of the second planar panel body contacts the back wall of the trough of the receiving member, and in a downhill direction until an end of the flange contacts the downwardly depending wall.

6. The method of claim 4, wherein the flange is capable of being inserted into the trough through the opening on the downhill side of the trough when the second panel is parallel with the first panel and the first and second panels are engaged with the underlying structure.

7. The method of claim 1, wherein the receiving member includes a joining flange disposed along a length of the receiving member for affixing the first panel to the underlying structure, and wherein the second uphill edge rests upon the joining flange.

8. A method of installing interlocking panels over an underlying structure, the method including steps of:

affixing an uphill panel on the underlying structure, wherein the uphill panel includes a generally rectangular first planar panel body having a downhill edge;

engaging an uphill edge of a downhill panel with the downhill edge of the uphill panel, wherein the downhill panel includes a generally rectangular second planar panel body, wherein an angled head of the uphill edge is slidably engaged with a receiving member of the downhill edge of the uphill panel, wherein the receiving member has a span which permits positional adjustment of the downhill panel within a space defined by the span; and affixing the downhill panel to the underlying structure, wherein a joining flange is disposed along a length of the receiving member for affixing the uphill panel to the underlying structure, wherein the joining flange is disposed between the underlying structure and the downhill panel after the downhill panel is affixed to the underlying structure, wherein the angled head includes a bevel proximate the joining flange.

9. The method of claim 8, wherein the angled head includes a flange that extends from the uphill edge of the downhill panel at an angle of less than 90 degrees from the second planar panel body, and wherein the flange is rotationally operable about the uphill edge at a living hinge.

10. The method of claim 8, wherein the receiving member includes a trough having a downwardly depending wall, a top wall, a back wall, and a bottom wall, wherein the back wall has a longer length than the downwardly depending wall.

11. The method of claim 10, wherein the bottom wall extends beyond the downhill edge of the first planar panel body to form the joining flange.

12. The method of claim 10, wherein the angled head includes a flange which extends from the uphill edge of the downhill panel at an angle of less than 90 degrees from the second planar panel body, and wherein a height that the flange extends from the second planar panel body is greater than a difference in length between the back wall and the downwardly depending wall.

13. The method of claim 10, wherein the angled head includes a flange which extends from the uphill edge of the downhill panel at an angle of less than 90 degrees from the second planar panel body, and wherein a length of the top wall is greater than a distance that the flange extends over the second planar panel body, wherein the angled head is capable of being inserted into the trough while the uphill and downhill panels are substantially co-planar and positioned on the underlying structure.

14. The method of claim 13, wherein the difference between the length of the top wall and the distance that the flange extends over the second planar panel body is equal to or greater than about 0.25 inches.

15. A method of installing a system of interlocking panels in a top-down pattern, the method comprising steps of:

attaching a generally rectangular first planar panel body to an underlying structure, the first planar panel body including a first uphill edge and an opposing first downhill edge, the first downhill edge having a receiving member;

engaging a generally rectangular second planar panel body to the first planar panel body, wherein the second planar panel body including a second uphill edge and an opposing second downhill edge, the second uphill edge having a beveled interlocking member, wherein the receiving member loosely receives the beveled interlocking member and permits positional adjustment of the second planar panel body in an uphill-downhill direction within a space defined by a span, wherein the beveled interlocking member is capable of being received in the receiving member while the second planar panel body is positioned in a single plane and engaged with the underlying structure; and attaching the second planar panel body to the underlying structure.

16. The method of claim 15, wherein the receiving member includes a joining flange disposed along a length of the receiving member for affixing the first planar panel body to the underlying structure.

17. The method of claim 15, wherein the beveled interlocking member includes a flange extending from the second uphill edge of the second planar panel body at an angle of less than 90 degrees from the second planar panel body.

18. The method of claim 17, wherein the receiving member includes a downwardly depending wall extending from the first planar panel body, a top wall, a back wall, and a bottom wall, wherein a height of the back wall is greater than a height of the downwardly depending wall, and the difference in height between the back wall and the downwardly depending wall defines an entrance channel to a trough.

19. The method of claim 18, wherein the step of engaging the generally rectangular second planar panel body to the first planar panel body includes sliding the flange through the entrance channel, wherein the downwardly depending wall biases the flange toward the underlying structure, and wherein when the flange is entirely within the trough, the flange is biased away from the underlying structure, wherein a height of the flange is greater than a height of the entrance channel.

20. The method of claim 18, wherein the beveled interlocking member includes a flange extending from the second uphill edge of the second planar panel body to form an angle of less than 90 degrees from the second planar panel body, and wherein a height of the flange from the second planar panel body is greater than the difference between the height of the back wall and the height of the downwardly depending wall.

* * * * *